US009272180B2

(12) United States Patent
Eschenbach

(10) Patent No.: US 9,272,180 B2
(45) Date of Patent: Mar. 1, 2016

(54) ROWING STEPPER EXERCISE APPARATUS

(71) Applicant: Paul William Eschenbach, Roebuck, SC (US)

(72) Inventor: Paul William Eschenbach, Roebuck, SC (US)

( * ) Notice: Subject to any disclaimer, the term of this patent is extended or adjusted under 35 U.S.C. 154(b) by 189 days.

(21) Appl. No.: 13/998,636

(22) Filed: Nov. 19, 2013

(65) Prior Publication Data

US 2015/0141207 A1 May 21, 2015

(51) Int. Cl.

| | |
|---|---|
| ***A63B 22/00*** | (2006.01) |
| ***A63B 23/035*** | (2006.01) |
| *A63B 71/00* | (2006.01) |
| *A63B 21/008* | (2006.01) |

(52) U.S. Cl.

CPC ..... *A63B 22/001* (2013.01); *A63B 22/0056* (2013.01); *A63B 22/0076* (2013.01); *A63B 21/0083* (2013.01); *A63B 21/0087* (2013.01); *A63B 71/0009* (2013.01); *A63B 2022/0033* (2013.01); *A63B 2022/0035* (2013.01); *A63B 2022/0038* (2013.01); *A63B 2022/0041* (2013.01); *A63B 2022/0084* (2013.01); *A63B 2208/0238* (2013.01)

(58) Field of Classification Search

CPC .. A63B 22/0664; A63B 22/001; A63B 22/04; A63B 22/0015; A63B 2022/067; A63B 2022/0682; A63B 22/0056; A63B 23/0458; A63B 23/03583; A63B 22/0076; A63B 22/201; A63B 22/203; A63B 22/208; A63B 23/00; A63B 23/035; A63B 23/03508; A63B 23/03516; A63B 23/03525; A63B 23/03533; A63B 23/03451; A63B 23/0355; A63B 23/03558; A63B 23/03575; A63B 23/03591; A63B 23/0423; A63B 23/0429; A63B 23/047; A63B 22/08; A63B 23/04

USPC ..... 482/52, 72

See application file for complete search history.

(56) References Cited

U.S. PATENT DOCUMENTS

| | | | | |
|---|---|---|---|---|
| 4,743,010 | A | 5/1988 | Geraci | |
| 4,867,447 | A | 9/1989 | Johnson | |
| 4,883,268 | A | 11/1989 | Salkind | |
| 4,976,423 | A | 12/1990 | Routti | |
| 5,104,363 | A | 4/1992 | Shi | |
| 5,106,081 | A | 4/1992 | Webb | |
| 5,356,356 | A | 10/1994 | Hildebrandt et al. | |
| 5,514,053 | A * | 5/1996 | Hawkins | A63B 21/15 482/63 |
| 5,569,130 | A | 10/1996 | Wang et al. | |
| 5,611,758 | A | 3/1997 | Rodgers, Jr. | |
| 5,616,105 | A | 4/1997 | Wang et al. | |
| 5,725,457 | A | 3/1998 | Maresh | |
| 5,779,600 | A | 7/1998 | Pape | |
| 5,803,880 | A * | 9/1998 | Allen | A63B 21/0087 482/113 |
| 5,836,855 | A | 11/1998 | Eschenbach | |
| 5,916,065 | A | 6/1999 | McBride et al. | |
| 5,938,570 | A | 8/1999 | Maresh | |
| 5,967,944 | A * | 10/1999 | Vittone | A63B 22/001 482/37 |

(Continued)

*Primary Examiner* — Stephen Crow
*Assistant Examiner* — Andrew S Lo

(57) ABSTRACT

The present invention relates to an exercise apparatus operated in a seated position where foot operated pedals and arm operated handles follow linear paths. More particularly, the present invention relates to an exercise apparatus having separately supported pedals for the feet and arm exercise coordinated with motion of the feet. The foot pedals and handles are positioned forward the operator to allow easy ingress and egress. The handles and pedals may be operated in unison for rowing exercise or the left handle and pedal may be operated independent of the right handle and pedal for opposing stepping exercise. Adjustable resistance is provided.

20 Claims, 3 Drawing Sheets

(56) References Cited

U.S. PATENT DOCUMENTS 5,997,446 A * 12/1999 Stearns ..... A63B 21/00072 482/56
6,042,518 A 3/2000 Hildebrandt et al.
6,077,197 A 6/2000 Stearns et al.
6,135,923 A * 10/2000 Stearns ..... A63B 22/001 482/51
6,254,514 B1 * 7/2001 Maresh ..... A63B 22/001 482/52
6,283,895 B1 9/2001 Stearns et al.
6,409,635 B1 6/2002 Maresh
6,666,799 B2 12/2003 Hildebrandt et al.
6,790,162 B1 9/2004 Ellis et al.
6,830,542 B2 12/2004 Ball et al.
6,926,647 B1 8/2005 Huang et al.
6,932,745 B1 8/2005 Ellis
7,104,933 B1 9/2006 Liao
7,141,008 B2 11/2006 Krull et al.
7,591,766 B2 9/2009 Ellis
7,641,597 B2 * 1/2010 Schmidt ..... A63B 21/0058 482/4
7,785,235 B2 * 8/2010 Lull ..... A63B 22/001 482/52
7,993,247 B1 * 8/2011 Eschenbach ..... A63B 22/001 482/51
2004/0259692 A1 * 12/2004 Martin ..... A63B 22/0007 482/52
2005/0032611 A1 * 2/2005 Webber ..... A63B 21/0628 482/72
2006/0172862 A1 * 8/2006 Badarneh ..... A63B 22/001 482/52
2007/0037667 A1 * 2/2007 Gordon ..... A63B 22/0017 482/51
2007/0087907 A1 * 4/2007 Rodgers, Jr. ..... A63B 21/05 482/52
2007/0161463 A1 * 7/2007 Eschenbach ..... A63B 22/001 482/52
2007/0161465 A1 * 7/2007 Eschenbach ..... A63B 22/001 482/52
2008/0153675 A1 * 6/2008 Eschenbach ..... A63B 22/001 482/52
2008/0248929 A1 * 10/2008 Webber ..... A63B 21/0615 482/96
2009/0105049 A1 * 4/2009 Miller ..... A63B 22/0017 482/52
2011/0172061 A1 * 7/2011 Eschenbach ..... A63B 22/0017 482/52
2011/0275485 A1 * 11/2011 Eschenbach ..... A63B 21/00069 482/52
2012/0035023 A1 * 2/2012 Eschenbach ..... A63B 21/00069 482/52
2012/0178589 A1 * 7/2012 Eschenbach ..... A63B 21/00069 482/52
2013/0012363 A1 * 1/2013 Eschenbach ..... A63B 21/00069 482/52
2013/0199317 A1 * 8/2013 Law ..... F16H 19/08 74/47
2013/0281271 A1 * 10/2013 Nizam ..... A63B 23/03558 482/139
2013/0331238 A1 * 12/2013 Ellis ..... A63B 21/159 482/97

* cited by examiner

ROWING STEPPER EXERCISE APPARATUS

FIELD

The present invention relates to an exercise apparatus operated in a seated position where foot operated pedals and handles for arm exercise follow generally linear paths. More particularly, the present invention relates to an exercise machine having separately supported pedals for the feet and arm exercise coordinated with motion of the feet.

STATE OF THE ART

The benefits of regular exercise to improve overall health, appearance and longevity are well documented in the literature. For exercise enthusiasts, the search continues for safe apparatus that provides full body exercise for maximum benefit in minimum time. Furthermore, the aging population tends to favor seated forms of exercise that encourage muscle tone.

The stationary rowing exercise apparatus is a commonly used apparatus today to elevate the heart rate and exercise the leg and upper body muscles. Typically, a handle and seat move while the feet rest in stationary pedals. Various examples are shown in: Geraci in U.S. Pat. No. 4,743,010, Johnson in U.S. Pat. No. 4,867,447, Wang et al. in U.S. Pat. Nos. 5,569,130 and 5,616,105, Pape in U.S. Pat. No. 5,779,600, Huang et al. in U.S. Pat. No. 6,926,647, Krull et al. in U.S. Pat. No. 7,141,008 and Ellis in U.S. Pat. No. 7,591,766.

Another group of rowing apparatus which have moving handles and foot pedals are: Salkind in U.S. Pat. No. 4,883,268, Routti in U.S. Pat. No. 4,976,423, Shi in U.S. Pat. No. 5,104,363, Ball et al. in U.S. Pat. No. 6,830,542 and Liao in U.S. Pat. No. 7,104,933.

In recent years, semi-recumbent or more commonly referred to as recumbent exercise apparatus have appeared that provide for back and forth pedal movement. Hawkins in U.S. Pat. No. 5,514,053 shows pedals that move back and forth along a linear path. Webb in U.S. Pat. No. 5,106,081 shows a leg exercise machine with pedals that move back and forth along an arc path. Hildebrandt et al. in U.S. Pat. No. 5,356,356 shows pedals that move back and forth along a circular path with arm exercise. Hildebrandt et al. in U.S. Pat. Nos. 6,042,518, 6,666,799 and Ellis et al. in U.S. Pat. No. 6,790,162 show back and forth pedal movement for a recumbent exerciser. Ellis in U.S. Pat. No. 6,932,745 also shows pedals that provide back and forth movement along a circular arc.

Another group of recumbent exercisers are emerging that use elliptical pedal movement for the feet. Rodgers, Jr. in U.S. Pat. No. 5,611,758 shows a recumbent exercise apparatus to generate an elliptical pedal movement using a crank, reciprocating member and roller/track to guide a pedal/foot member pivotally connected to the reciprocating member and a handle member. Eschenbach in U.S. Pat. No. 5,836,855, Maresh in U.S. Pat. Nos. 5,725,457, 5,938,570 and 6,409,635 show elliptical foot motion for recumbent seated operation. Martin et al. in Pat. Application No. US 2004/0259692 shows pedal movements for a semi-recumbent exerciser. Stearns et al. in U.S. Pat. Nos. 6,077,197 and 6,283,895 show inclined pedals with elliptical movement for an operator leaning against a back support. McBride et al. in U.S. Pat. No. 5,916,065 shows elliptical pedal movement intended for stand-up operation in a seated position.

There is a need for a seat operated exercise apparatus that functions as a rowing apparatus where the hands and feet move together and as a stepping apparatus where the hands and feet have independent opposing movements. There is also a need to articulate the pedals to provide dorsi-flexion and plantar flexion foot exercise without raising the heel or toe from the pedal. There is a further need to provide a rowing stepper that allows easy ingress and egress.

SUMMARY OF THE INVENTION

The present invention relates to the kinematic motion control of pedals which provide extended leg exercise in a seated position. More particularly, apparatus is provided that offers variable intensity exercise through leg operated motion in which the pedal supporting each foot is guided through successive positions during the motion cycle while a load resistance acts upon the mechanism. Linkage is provided to coordinate arm exercise.

The operator of the present exercise apparatus is positioned in a stationary seat which is supported by a generally horizontal surface. Foot pedals are configured to allow easy ingress and egress. A pair of pedal linkages guide the pedals along an inclined linear path. The pedal linkage comprises a plurality of links containing a pedal, pedal support, lower link, lower central link, lower end link and a pedal position link. The pedal position link controls the angle of the pedal relative to the lower leg of the operator keeping the angle near ninety degrees during operation to maintain both the heel and toe of the operator generally in contact with the pedal.

A pair of arm linkages guide the handles along an inclined linear path. Each arm linkage comprises a handle, handle support, upper central link and upper end link.

The upper central link and the lower central link are attached to each other as a central link in the preferred embodiment so that when each handle moves towards the operator, a respective pedal moves away from the operator. When combined with central links, the pedal linkages and arm linkages combine to form a left assembly linkage and a right assembly linkage. Each linkage assembly can be operated independently for stepping exercise or in unison for rowing exercise.

Resistance is provided by a pair of resistance cylinders, each resistance cylinder acting upon a respective linkage assembly. The resistance cylinders are independently adjustable to vary the effort required to operate each linkage assembly.

A stationary seat is provided for the operator that can be repositioned to accommodate shorter or taller operators. The linkage assemblies are designed to allow easy ingress and egress and offer an operator either rowing or stepping exercise.

An alternate embodiment is shown that uses a single linkage assembly positioned in the center of the exercise apparatus. The pedal is wider to accommodate both feet of the operator. A single handle is used extending on either side of the handle support to provide a T-handle for both hands of the operator. The alternate embodiment is used for rowing exercise only.

In summary, the present invention provides hand and foot exercise for a seated operator. Operator access is enhanced because the pedals and handles are positioned forward the operator. Further, rowing exercise occurs when the handles and pedals are operated side by side and stepping exercise occurs when the left handle and pedal are operated independent of the right handle and pedal in opposing directions. The pedals articulate to maintain the heels and toes of the operator generally in contact with the pedals during operation of the exercise apparatus.

DETAILED DESCRIPTION OF THE EMBODIMENTS

Figure 1:
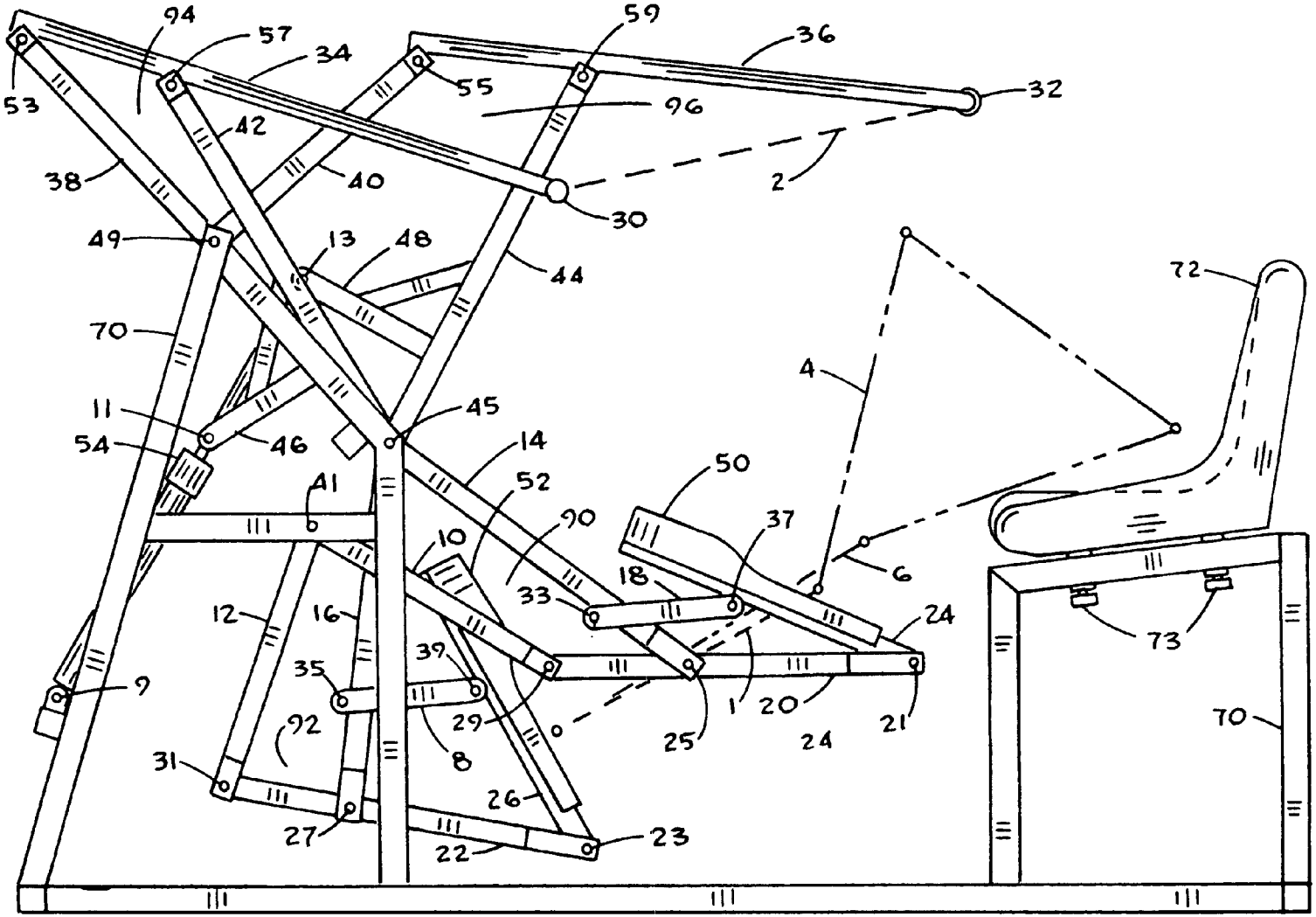
FIG. 1 is a left side elevation view of the preferred embodiment of an exercise apparatus constructed in accordance with the present invention for an operator in a seated position.
Figure 2:
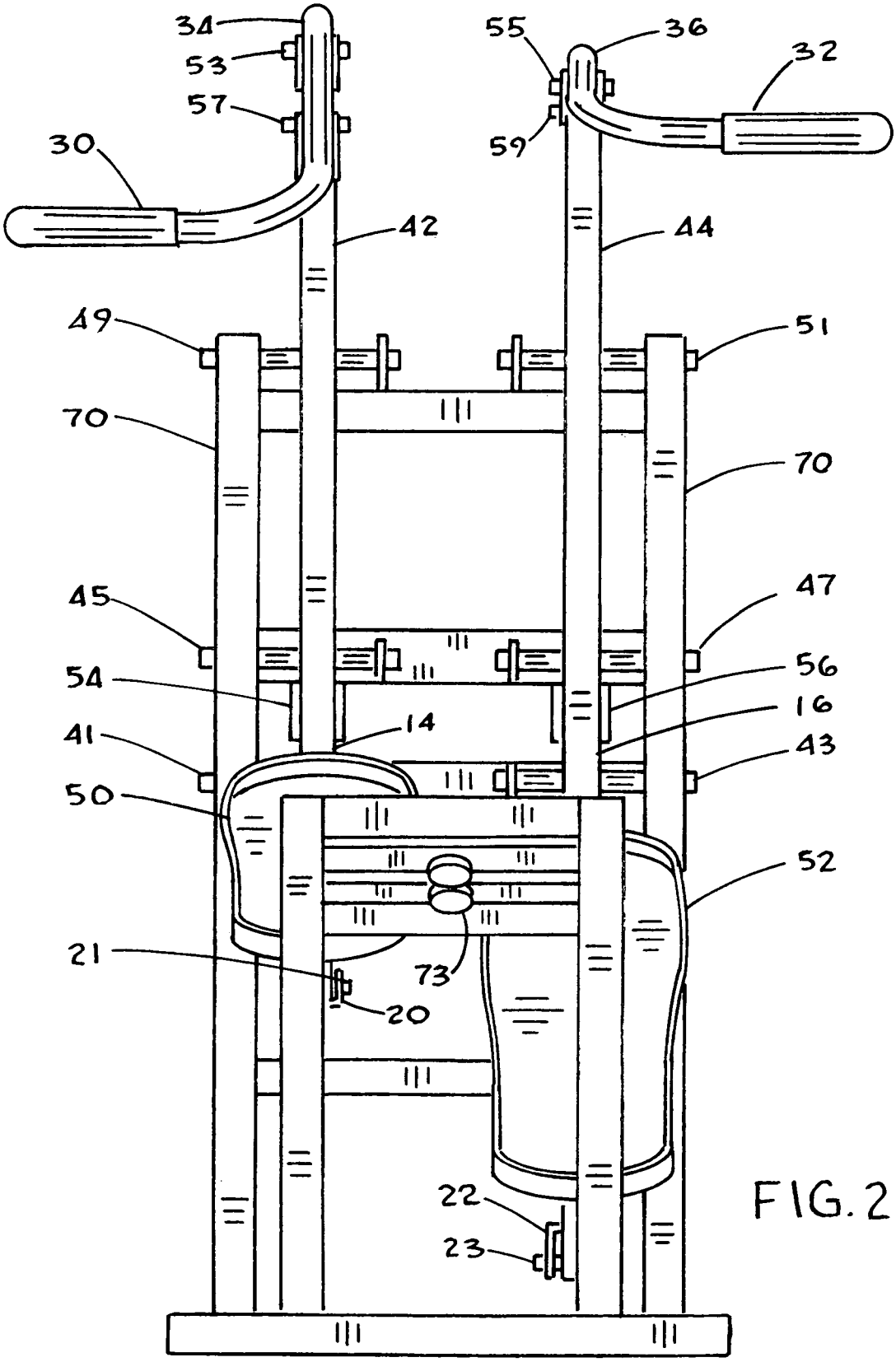
FIG. 2 is an end view of the preferred embodiment of the present invention shown in FIG. 1 without the seat for clarity.

Referring to the drawings in detail, pedals 50,52 are shown in FIGS. 1 and 2 attached to pedal supports 24,26 which are connected to lower links 20,22 at pivots 21,23. Lower central links 14,16 are connected to lower links 20,22 at pivots 25,27 and to framework 70 at pivots 45,47. Pedal position links 18,8 are connected to the pedal supports 24,26 at pivots 37,39 and to lower central links 14,16 at pivots 33,35. Lower end links 10,12 are connected to lower links 20,22 at pivots 29,31 and to framework 70 at pivots 41,43.

As force is applied to pedal 50 by the lower leg 4 of the operator, pedal 50 moves with lower leg 4 generally perpendicular to pedal 50 so that the heel and toe of the operator remain in contact with pedal 50. Pedals 50,52, pedal supports 24,26, lower links 20,22, lower central links 14,16, lower end links 10,12 and pedal position links 18,8 form pedal linkages 90,92 that guide pedals 50,52 along inclined linear path 1. Pedal 50 moves down inclined linear path 1 until the lower leg 4 is fully extended as lower leg 6 is generally perpendicular to pedal 52. Pedals 50,52 can move together in the same direction along inclined path 1 or separately with independent opposing motions.

Handles 30,32 are attached to handle supports 34,36 and follow linear path 2. Upper central links 42,44 are connected to handle supports 34,36 at pivots 57,59 and to framework 70 at pivots 45,47. Upper end links 38,40 are connected to handle supports 34,36 at pivots 53,55 and to framework 70 at pivots 49,51. Handles 30,32, handle supports 34,36, upper central links 42,44 and upper end links 38,40 form an arm linkage 94,96 that guide handles 30,32 along linear path 2.

Lower central links 14,16 and upper central links 42,44 share common pivots 45,47 and are attached to each other in this embodiment to form central links 14/42 and 16/44. Therefore, as handles 30,32 move along path 2, pedals 50,52 move along path 1. When pedals 50,52 and handles 30,32 are used side by side, a rowing exercise occurs. When handles 30,32 and pedals 50,52 move in independent opposing directions, a stepping exercise occurs. Pedal linkage 90 and arm linkage 94 combine to form a left linkage assembly 90/94. Pedal linkage 92 and arm linkage 96 combine to form a right assembly linkage 92/96.

Resistance to leg and arm effort is provided by adjustable resistance cylinders 54,56 which are connected to load links 46,48 at pivots 11,13 and to framework 70 at pivots 9. Load links 46,48 are attached to upper central links 42,44. Of course, other forms of resistance such as weights may also be used. Seat 72 is supported by framework 70 and can be repositioned forward or rearward by using knobs 73.

Figure 3:
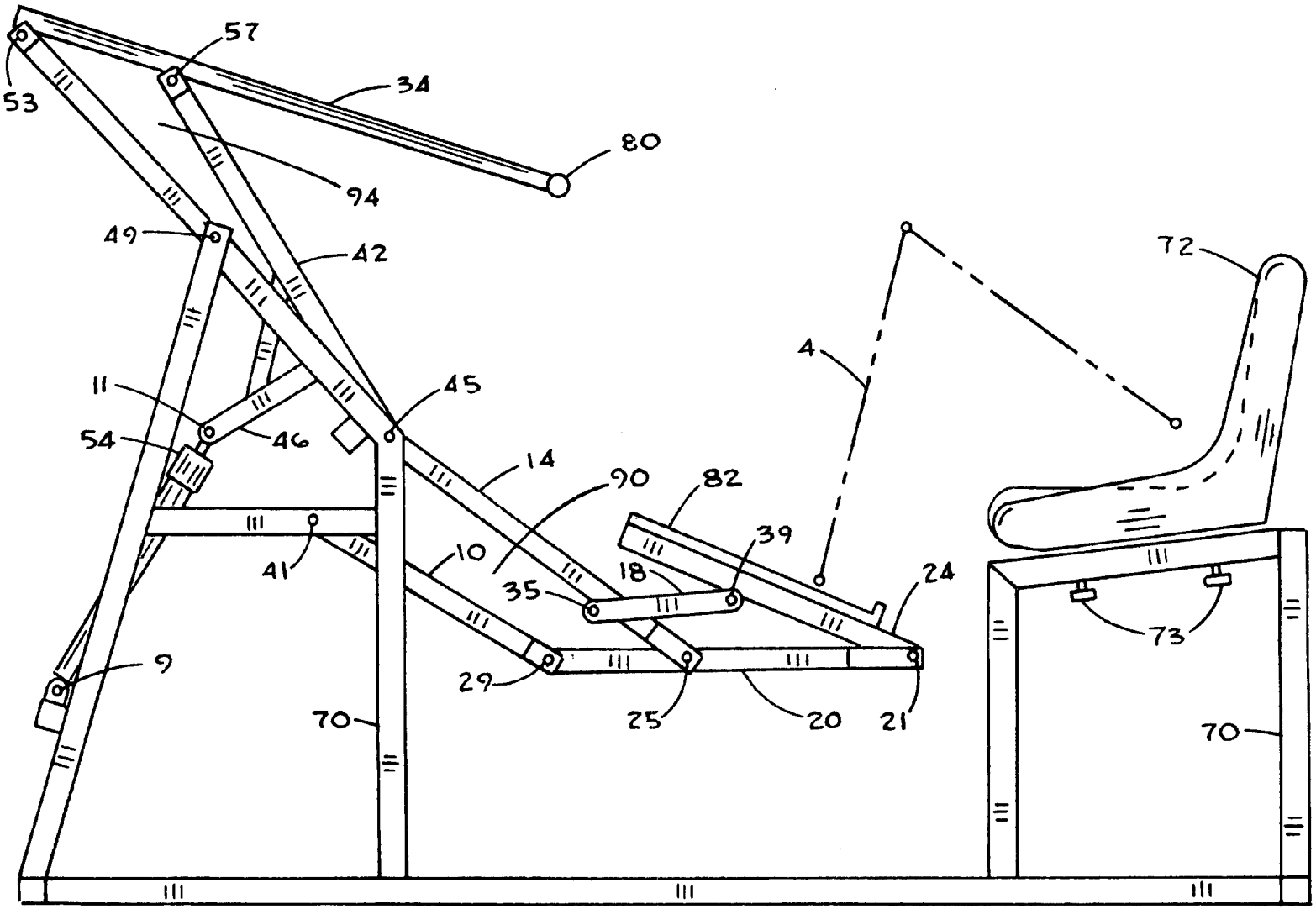
FIG. 3 is a left side elevation view of an alternate embodiment intended for rowing only.

FIG. 3 shows an alternative embodiment where linkage assembly 90/94 is moved to the center of the exercise apparatus. Pedal 50 has been replaced by pedal plate 82 which is wide enough to accommodate both feet of the operator. T-handle 80 replaces handle 30 and extends on either side of handle support 34 for both hands of the operator. Resistance cylinder 54 is adjustable to provide resistance to operator effort. This simpler alternate embodiment provides for rowing only.

In summary, the present invention provides hand and foot exercise for a seated operator. Operator access is enhanced because the pedals and handles are positioned forward the operator. Further, rowing exercise occurs when the handles and pedals are operated side by side and stepping exercise occurs when the left handle and pedal are operated independent of the right handle and pedal in opposing directions. The pedals articulate to maintain the heels and toes of the operator generally in contact with the pedals during operation of the exercise apparatus.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising;

a framework, said framework configured to be supported by a generally horizontal surface;

a pedal linkage, said pedal linkage comprising a plurality of links connected with said framework including a pedal for leg exercise;

an arm linkage, said arm linkage comprising a plurality of links connected with said framework including a handle for arm exercise where said arm linkage remains above said pedal linkage during operation of said exercise apparatus;

said pedal linkage connected with said arm linkage comprising a linkage assembly;

a resistance device, said resistance device connected with said linkage assembly to exert a resistance force upon said pedal and said handle;

said pedal configured to move relative to said framework when an operator in a seated position is exerting force upon said pedal and said handle whereby with the operator's hands and feet said pedal and said handle follow generally linear paths during operation of said exercise apparatus.

2. The exercise apparatus according to claim 1 wherein said handle moves towards said operator when said pedal moves away from said operator for rowing exercise.

3. The exercise apparatus according to claim 1 comprising a left linkage assembly for operation by a left hand and left foot of said operator and a right linkage assembly for operation by a right hand and right foot of said operator whereby each linkage assembly may be operated independently of the other linkage assembly for stepping exercise.

4. The exercise apparatus according to claim 1 wherein said pedal linkage comprises said pedal attached to a pedal support, said pedal support pivotally connected to a lower link and a pedal position link;

a lower central link, said lower central link pivotally connected to said lower link, said pedal position link and said framework;

a lower end link, said lower end link pivotally connected to said lower link and said framework.

5. The exercise apparatus according to claim 1 wherein said arm linkage comprises said handle, said handle attached to a handle link;

an upper central link, said upper central link pivotally connected to said handle link and said framework;

an upper end link, said upper end link pivotally connected to said handle link and to said framework.

6. The exercise apparatus according to claim 1 wherein said pedal linkage and said pedal linkage share a common central link pivotally connected to said framework intermediate the ends of said central link.

7. The exercise apparatus according to claim 6 wherein said resistance device is pivotally connected to said central link and said framework.

8. The exercise apparatus according to claim 1 wherein said resistance device is adjustable to vary the effort required to operate said pedal and said handle.

9. The exercise apparatus according to claim 1 further comprising a seat, said seat positioned upon said framework to be adjustable to accommodate operators of different leg and arm lengths.

10. An exercise apparatus comprising;

a framework, said framework configured to be supported by a generally horizontal surface;

a left pedal linkage, said left pedal linkage comprising a plurality of links connected with said framework including a pedal for exercise of a left foot of an operator;

a left arm linkage, said left arm linkage connected with said framework including a left handle for arm exercise by said operator;

said left pedal linkage connected with said left arm linkage comprising a left linkage assembly;

a right pedal linkage, said right pedal linkage comprising a plurality of links connected with said framework including a right pedal for exercise of a right foot of said operator;

a right arm linkage, said right arm linkage connected with said framework including a right handle for arm exercise by said operator;

said right pedal linkage connected with said right arm linkage comprising a right linkage assembly;

a pair of resistance devices, each said resistance device connected with a respective said linkage assembly to exert a resistance force upon said pedal and said handle;

said pedals and handles configured to move relative to said framework when the feet and hands of said operator are exerting force upon said pedals and said handles whereby said pedals and said handles follow generally linear paths during operation of said exercise apparatus.

11. The exercise apparatus according to claim 10 wherein said handles move in similar directions and said pedals move in similar directions to simulate rowing exercise.

12. The exercise apparatus according to claim 10 wherein said handles move in opposing directions and said pedals move in opposing directions to provide stepping exercise.

13. The exercise apparatus according to claim 10 further comprising a seat, said seat positioned upon said framework to be adjustable to accommodate operators of different leg and arm lengths.

14. The exercise apparatus according to claim 10 wherein said resistance devices are adjustable to vary the effort required to operate said pedals and said handles.

15. The exercise apparatus according to claim 10 wherein said pedal linkage comprises said pedal attached to a pedal support, said pedal support pivotally connected to a lower link and a pedal position link;

a lower central link, said lower central link pivotally connected to said lower link, said pedal position link and said framework;

a lower end link, said lower end link pivotally connected to said lower link and said framework.

16. The exercise apparatus according to claim 10 wherein said arm linkage comprises said handle, said handle attached to a handle link;

an upper central link, said upper central link pivotally connected to said handle link and said framework;

an upper end link, said upper end link pivotally connected to said handle link and to said framework.

17. An exercise apparatus comprising;

a framework, said framework configured to be supported by a generally horizontal surface;

a pedal attached to a pedal support, said pedal support pivotally connected to a lower link and a pedal position link;

a central link, said central link pivotally connected to said lower link, said pedal position link and said framework;

a lower end link, said lower end link pivotally connected to said lower link and said framework;

a handle, said handle attached to a handle link;

said central link pivotally connected to said handle link;

an upper end link, said upper end link pivotally connected to said handle link and to said framework;

said pedal, said pedal support, said lower link, said pedal position link, said central link, said lower end link, said handle, said handle link and said upper end link comprise a linkage assembly;

a resistance device, said resistance device connected with said central link to exert a resistance force upon said pedal and said handle;

said pedal configured to move relative to said framework when an operator is exerting force upon said linkage assembly whereby said pedal follows an inclined path during operation of said exercise apparatus.

18. The exercise apparatus according to claim 17 comprising a left linkage assembly for operation by the left hand and left foot of said operator and a right linkage assembly for operation by the right hand and right foot of said operator whereby each said linkage assembly may be operated independently of the other said linkage assembly for stepping exercise.

19. The exercise apparatus according to claim 17 wherein said handle moves towards said operator when said pedal moves away from said operator for rowing exercise.

20. The exercise apparatus according to claim 17 wherein said resistance device is adjustable to vary the effort required to operate said pedal and said handle.

* * * * *